US008210134B2

(12) United States Patent
Shimokawa

(10) Patent No.: US 8,210,134 B2
(45) Date of Patent: Jul. 3, 2012

(54) CHAIN SAW

(75) Inventor: Kouichi Shimokawa, Kawagoe (JP)

(73) Assignee: Husqvarna Zenoah Co., Ltd., Kawagoe-Shi (JP)

( * ) Notice: Subject to any disclaimer, the term of this patent is extended or adjusted under 35 U.S.C. 154(b) by 1028 days.

(21) Appl. No.: 12/087,530

(22) PCT Filed: Jan. 11, 2007

(86) PCT No.: PCT/JP2007/050733

§ 371 (c)(1),
(2), (4) Date: Jul. 9, 2008

(87) PCT Pub. No.: WO2007/081055

PCT Pub. Date: Jul. 19, 2007

(65) Prior Publication Data

US 2009/0007438 A1 Jan. 8, 2009

(30) Foreign Application Priority Data

Jan. 13, 2006 (JP) ..... 2003-006752

(51) Int. Cl.
*F01P 7/04* (2006.01)

(52) U.S. Cl. ..... 123/41.7; 123/41.65; 30/381; 181/227

(58) Field of Classification Search ..... 30/381–387; 123/41.67, 41.7, 198 E, 41.56, 41.63, 41.65; 60/320, 321, 314; 181/227, 228, 259, 265, 181/272

See application file for complete search history.

(56) References Cited

U.S. PATENT DOCUMENTS

| | | | | | |
|---|---|---|---|---|---|
| 2,827,932 | A | * | 3/1958 | Strunk | 30/386 |
| 3,678,973 | A | | 7/1972 | Loop | |
| 3,974,566 | A | | 8/1976 | Pilatowicz | |
| 3,994,067 | A | | 11/1976 | Hazzard et al. | |
| 4,060,985 | A | * | 12/1977 | Fukushima | 60/319 |
| 4,142,607 | A | | 3/1979 | Landwehr et al. | |
| 4,382,333 | A | | 5/1983 | Nagashima et al. | |
| 4,406,066 | A | | 9/1983 | Itzrodt | |
| 4,413,705 | A | | 11/1983 | Inaga et al. | |
| 4,450,933 | A | | 5/1984 | Fukuoka et al. | |

(Continued)

FOREIGN PATENT DOCUMENTS

EP 1 424 487 A2 6/2004

(Continued)

OTHER PUBLICATIONS

K. Shimokawa, "Chain Saw", related U.S. Appl. No. 12/087,571, filed Jul. 10, 2008.

(Continued)

*Primary Examiner* — Noah Kamen
(74) *Attorney, Agent, or Firm* — Holtz, Holtz, Goodman & Chick, PC

(57) ABSTRACT

A chain saw includes a body in which an engine for driving a saw chain is laterally housed; a top handle provided above the body; and a muffler arranged below the engine, in which an exhaust outlet for discharging exhaust from the front side of the body to the outside opens forward from the front side of the body. Accordingly, not only the exhaust can be discharged forward from the front side of the body, but also the exhaust sound can be propagated forward so that less exhaust sound is heard by the operator, thereby improving the work environment.

3 Claims, 9 Drawing Sheets

U.S. PATENT DOCUMENTS

| | | | | |
|---|---|---|---|---|
| 4,592,445 | A | 6/1986 | Sawada | |
| 4,594,083 | A | 6/1986 | Hiraizumi | |
| 4,727,651 | A | 3/1988 | Nakajima | |
| 4,765,282 | A * | 8/1988 | Nagashima | 123/41.7 |
| 4,787,924 | A | 11/1988 | Nagashima et al. | |
| 4,936,271 | A | 6/1990 | Nagashima et al. | |
| 5,018,492 | A | 5/1991 | Wolf et al. | |
| 5,029,393 | A | 7/1991 | Nagashima et al. | |
| 5,080,048 | A | 1/1992 | Kudo | |
| 5,199,389 | A | 4/1993 | Wolf et al. | |
| 5,212,886 | A | 5/1993 | Tasaki | |
| 5,215,049 | A | 6/1993 | Wolf | |
| 5,243,764 | A | 9/1993 | Wieland | |
| 5,373,119 | A | 12/1994 | Suzuki et al. | |
| 5,595,153 | A | 1/1997 | Höppner et al. | |
| 5,722,237 | A | 3/1998 | Iida et al. | |
| 5,727,506 | A | 3/1998 | Tajima et al. | |
| 6,112,708 | A | 9/2000 | Sawada et al. | |
| 6,216,650 | B1 | 4/2001 | Noguchi | |
| 6,314,922 | B1 | 11/2001 | Zimmermann et al. | |
| 6,637,117 | B2 | 10/2003 | Kobayashi | |
| 6,896,245 | B2 | 5/2005 | Suzuki et al. | |
| 6,955,042 | B1 * | 10/2005 | Wnuck et al. | 60/286 |
| 7,156,202 | B2 * | 1/2007 | Assad | 181/258 |
| 7,341,027 | B2 | 3/2008 | Sugiyama | |
| D573,860 | S | 7/2008 | Shimokawa et al. | |
| D576,005 | S | 9/2008 | Shimokawa et al. | |
| D577,557 | S | 9/2008 | Shimokawa et al. | |
| 7,946,040 | B2 | 5/2011 | Sugishita | |
| 2003/0075123 | A1 | 4/2003 | Araki et al. | |
| 2003/0075132 | A1 | 4/2003 | Ohsawa et al. | |
| 2003/0183208 | A1 | 10/2003 | Nara et al. | |
| 2005/0183270 | A1 | 8/2005 | Schmidt et al. | |
| 2009/0000130 | A1 | 1/2009 | Shimokawa | |
| 2009/0100689 | A1 | 4/2009 | Shimokawa | |
| 2010/0083511 | A1 | 4/2010 | Shimokawa et al. | |
| 2010/0083512 | A1 | 4/2010 | Shimokawa et al. | |
| 2011/0072671 | A1 | 3/2011 | Tsuruoka | |

FOREIGN PATENT DOCUMENTS

| | | | |
|---|---|---|---|
| EP | 1 967 337 | A1 | 9/2008 |
| JP | 53-044998 | A | 4/1978 |
| JP | 54-90795 | U | 6/1979 |
| JP | 57-39203 | U | 3/1982 |
| JP | 57-58282 | B2 | 12/1982 |
| JP | 60-12885 | Y2 | 4/1985 |
| JP | 63-21362 | Y2 | 6/1988 |
| JP | 2-34725 | U | 3/1990 |
| JP | 3-58281 | B2 | 9/1991 |
| JP | 3-52981 | Y2 | 11/1991 |
| JP | 5-33657 | A | 2/1993 |
| JP | 9-151739 | A | 6/1997 |
| JP | 2000-310123 | A | 11/2000 |
| JP | 3167318 | B2 | 5/2001 |
| JP | 3186836 | B2 | 5/2001 |
| JP | 2001-355446 | A | 12/2001 |
| JP | 2007-185894 | A | 7/2007 |
| JP | 2007-262984 | A | 10/2007 |
| WO | WO 2007/074822 | | 7/2007 |
| WO | WO 2007/081043 | A1 | 7/2007 |
| WO | WO 2007/081055 | A1 | 7/2007 |

OTHER PUBLICATIONS

K. Shimokawa, "Chain Saw", related U.S. Appl. No. 12/245,868, filed Oct. 6, 2008.

K. Shimokawa, "Chain Saw", related U.S. Appl. No. 12/245,876, filed Oct. 6, 2008.

Japanese Office Action dated Aug. 2, 2011 (and English translation thereof) in counterpart Japanese Application No. 2006-006752.

* cited by examiner

CHAIN SAW

This application is a U.S. National Phase Application under 35 USC 371 of International Application PCT/JP2007/050733 filed Jan. 11, 2007.

TECHNICAL FIELD

The present invention relates to a chain saw.

BACKGROUND ART

There has been conventionally known a chain saw as equipment for performing tree-cutting, tree-pruning, branch-trimming and the like. The chain saw includes a flat-plate shaped guide bar, a body supporting the guide bar, and a handle connected to the body and gripped by an operator. An engine for driving a saw chain wound around the guide bar is housed in the body. Also housed in the body are an oil tank, a fuel tank, a muffler and the like for the engine. As examples of such a chain saw, there are top handle type chain saws in which the handle is provided above the body (refer to, for example, Document 1; Patent Publication No. 3186836, and Document 2: Japanese Utility Model Laid-Open No. Hei2-34725).

However, in these chain saws, since an exhaust outlet for discharging the exhaust from the muffler is arranged on a lateral side of the body, the exhaust is discharged to the lateral side of the body. Accordingly, when the exhaust is discharged, exhaust sound is easy to be propagated to the operator, therefore good work environment can not be achieved.

DISCLOSURE OF INVENTION

An object of the present invention is to provide a chain saw in which less exhaust sound is heard by the operator, thereby improving the work environment.

A chain saw according to the present invention includes: a body in which an engine for driving a saw chain is laterally housed; a top handle provided above the body; and a muffler arranged below the engine, in which an exhaust outlet for discharging exhaust from the front side of the body to the outside is opened forward from the front side of the body.

With such an arrangement, since the exhaust outlet opens forward from the front side of the body, not only can the exhaust be discharged forward from the front side of the body, but also the exhaust sound can be propagated forward so that less exhaust sound is heard by the operator, thereby improving the work environment.

According to another aspect of the present invention, it is preferred that in the aforesaid chain saw, the muffler is provided with an air introducing port for allowing a cooling air from the engine to flow therein.

With such an arrangement, since the cooling air flows into the muffler, the cooling air is mixed with the exhaust, and therefore the exhaust can be directly cooled.

According to another aspect of the present invention, it is preferred that in the aforesaid chain saw, the muffler is provided with a first muffling chamber that communicates with the engine through an exhaust pipe; a second muffling chamber that communicates with the first muffling chamber and covers a lower side of the first muffling chamber; and a third muffling chamber that communicates with the second muffling chamber and covers an upper side of the first muffling chamber, and the third muffling chamber is further provided with the air introducing port and a discharge port from which the exhaust is discharged to the exhaust outlet.

With such an arrangement, since the first, second and third muffling chambers are provided inside the muffler, the exhaust sound can be effectively reduced. Further, since the air introducing port is provided in the third muffling chamber that is arranged above the first and second muffling chambers and therefore is closer to the engine than the first and second muffling chambers are, the cooling air from the engine can smoothly flow therein, so that the exhaust can be effectively cooled. Further, since the cooling air blown into the third muffling chamber cools an upper wall of the first muffling chamber positioned on the lower side of the third muffling chamber, the exhaust from the engine can be cooled to some extent in the first muffling chamber. Further, since the third muffling chamber is arranged closer to the engine than the first and second muffling chambers are, the radiant heat of the first and second muffling chambers will not be directly transmitted to the engine.

BEST MODE FOR CARRYING OUT THE INVENTION

[Entire Arrangement of Chain Saw]

A preferred embodiment of the present invention will be described below with reference to the attached drawings.

Figure 1:
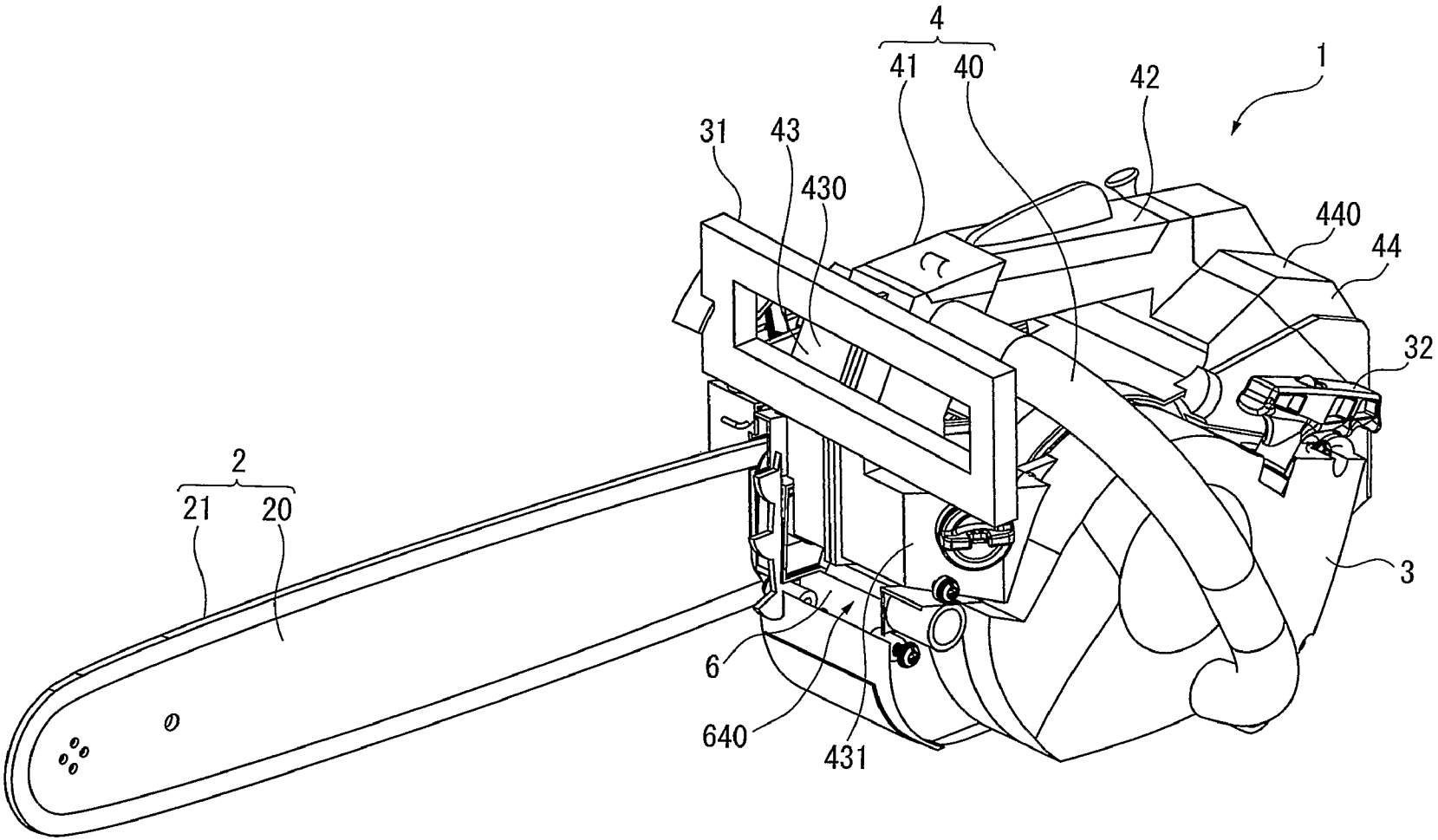
FIG. 1 is an entire perspective view showing a chain saw according to an embodiment of the present invention.
Figure 2:
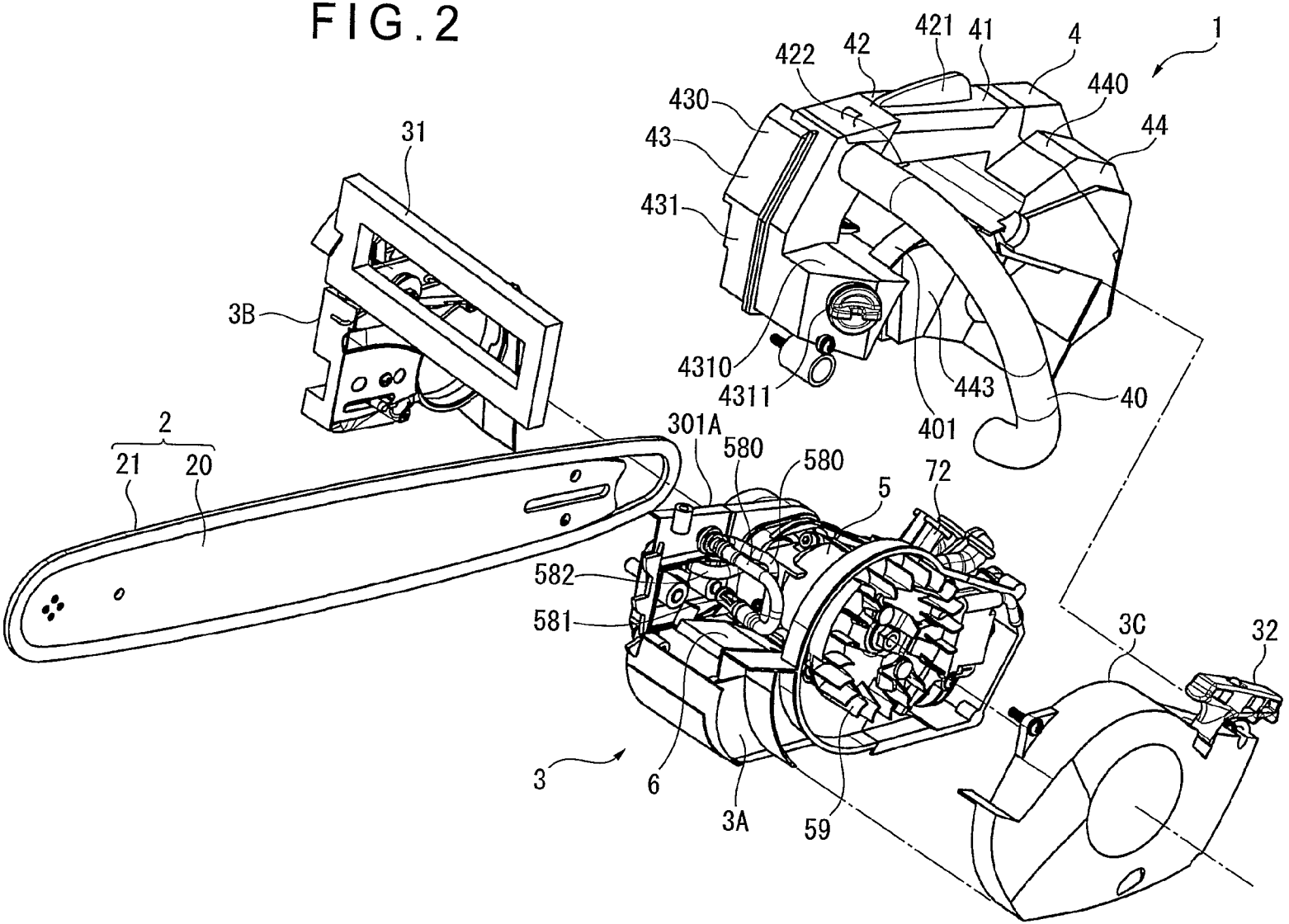
FIG. 2 is an exploded perspective view showing the chain saw according to the aforesaid embodiment of the present invention.

FIG. 1 is an entire perspective view showing a chain saw 1 according to the present embodiment. FIG. 2 is an exploded perspective view showing the chain saw 1.

As shown in FIG. 1, the chain saw 1 includes a chain portion 2, a body 3 and a handle 4 supporting the body 3.

Here, in FIG. 1, a projection direction of a guide bar 20 is defined as a front-and-rear direction, a direction orthogonal to the front-and-rear direction in the vertical direction is defined as an up-and-down direction, and a direction orthogonal to the front-and-rear direction in the lateral direction is defined as a right-and-left direction.

As shown in FIG. 2, the chain portion 2 includes the flat-plate shaped guide bar 20 and a saw chain 21 wound around the guide bar 20.

The body 3 is covered by a body case 3A, a case cover 3B attached to a right side of the body case 3A so that the guide bar 20 is sandwiched therebetween, and a case cover 3C attached to a left side of the body case 3A. An engine 5 for driving the saw chain 21 is provided inside the body case 3A. A hand guard 31 is provided above a front portion of the case cover 3B. A handle 32 of a recoil starter is provided on the case cover 3C. The handle 4 includes a side handle 40 and a top handle 41 both arranged above the body 3. Further, as shown in FIGS. 1 and 2, a gap is formed between a lower surface of a front portion of the top handle 41 and an upper surface of a front portion of the muffler 6, and a front end portion of the gap serves as an exhaust outlet 640 that opens forward from the front side of the body 3.

[Arrangement of Engine]

Figure 3:
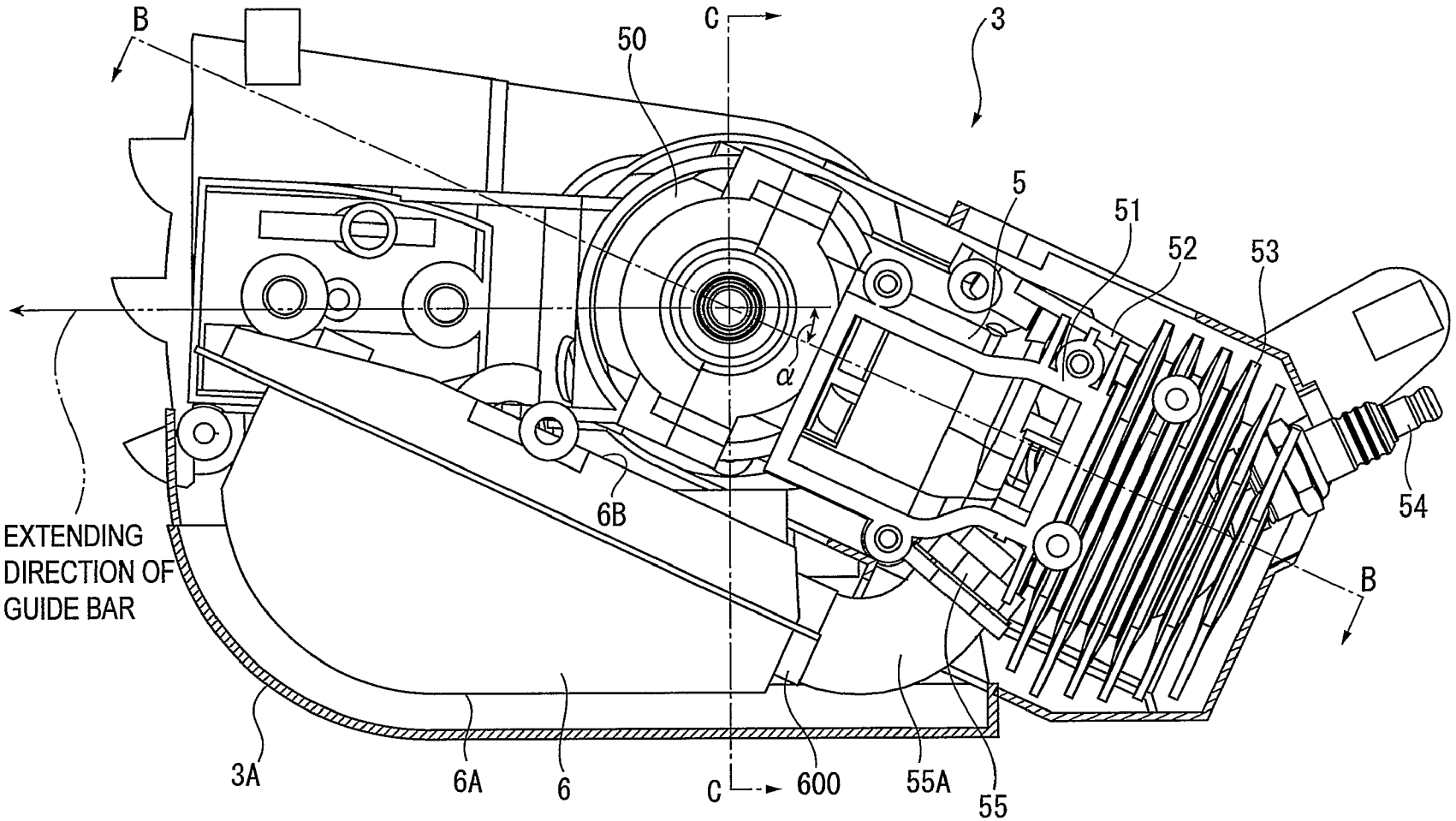
FIG. 3 is a cross section showing a body according to the aforesaid embodiment.
Figure 4:
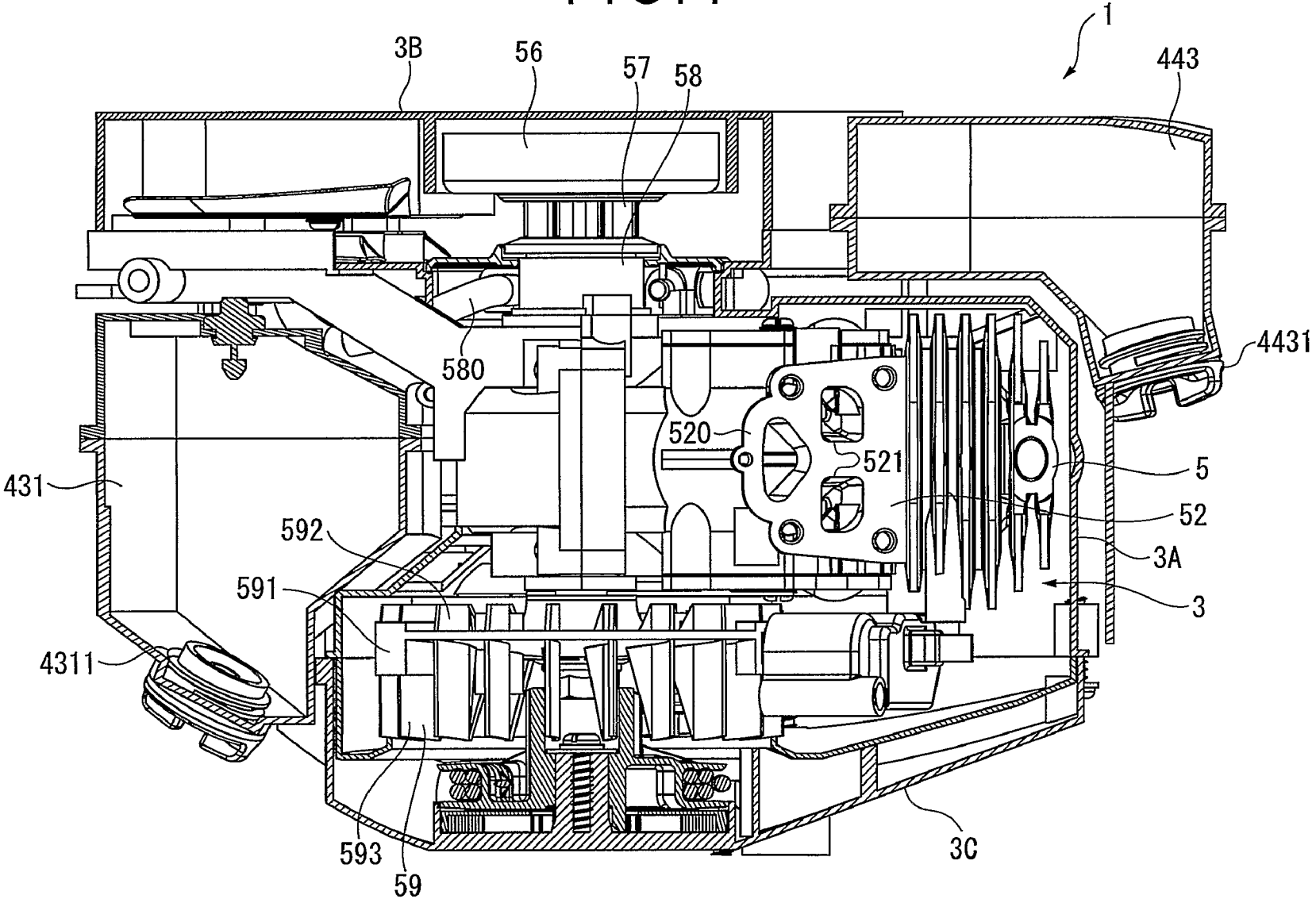
FIG. 4 is a cross section showing the chain saw according to the aforesaid embodiment.
Figure 5:
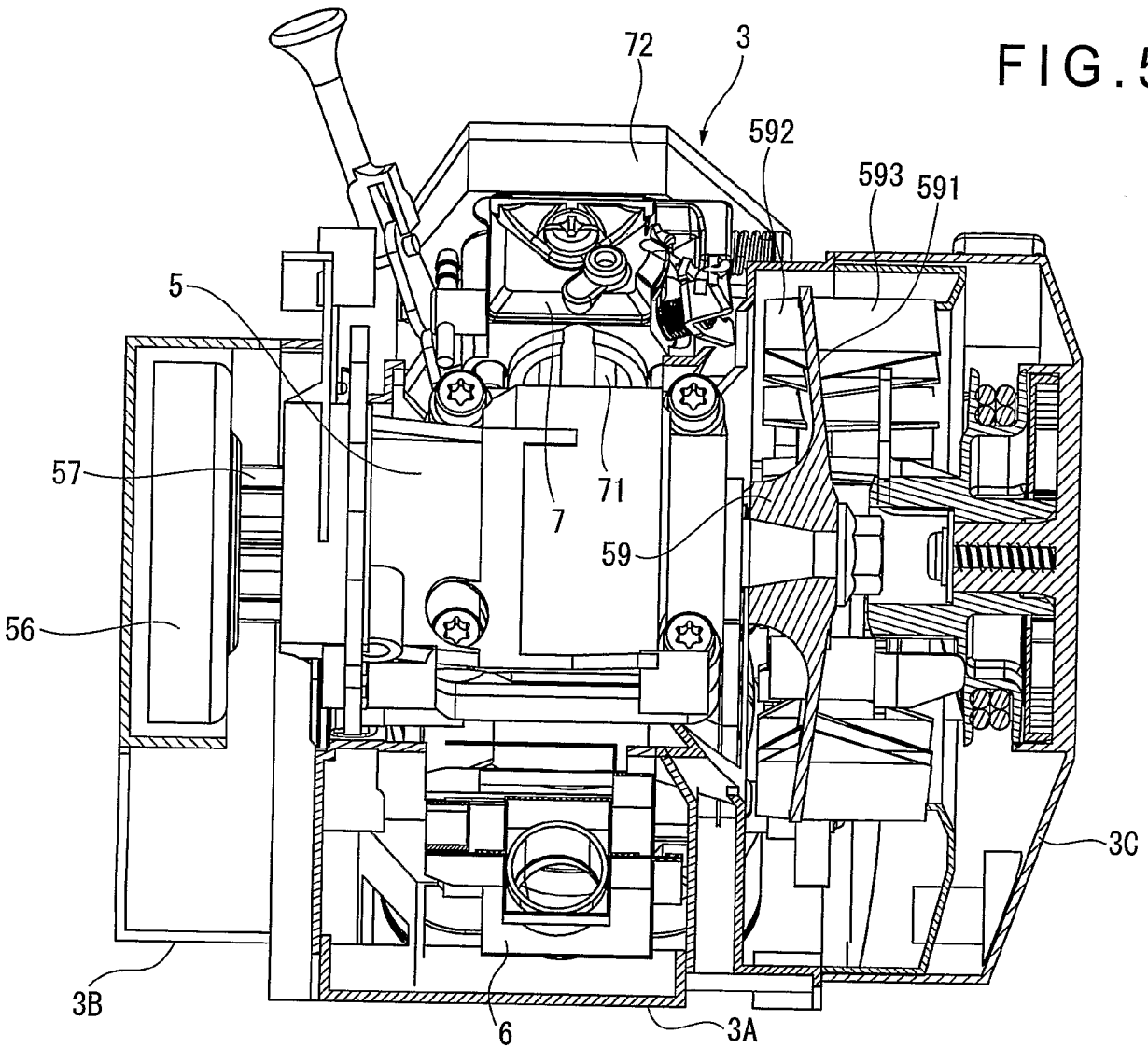
FIG. 5 is another cross section showing the chain saw according to the aforesaid embodiment.

FIG. 3 is a cross section of the body 3, FIG. 4 is a cross section taken along line B-B of FIG. 3, and FIG. 5 is a cross section taken along line C-C of FIG. 3. Incidentally, the engine 5 is not sectioned.

The engine 5 is a stratified scavenging 2-cycle engine. The engine 5 takes in air-fuel mixture from an air-fuel mixture port 520 opening in an insulator attaching portion 52 above a cylinder 51 and takes in scavenging air from an air port 521. In the cylinder 51, the exhaust is discharged from an exhaust port 55 formed below at a portion facing the air-fuel mixture port 520 and the air port 521. In other words, an intake direction in which both the air-fuel mixture and the scavenging air are taken in and an exhaust direction in which the exhaust is discharged are arranged substantially on a straight line in the up-and-down direction. A piston valve type system is adopted in which the air-fuel mixture is taken in by opening/closing the air-fuel mixture port 520 with a side surface of the piston.

The engine 5 is housed in the body case 3A in such a manner that the cylinder is arranged in a lateral position. Specifically, the engine 5 is housed in the body case 3A in such a manner that the cylinder 5 is extended rearward and slightly downward from a crank case 50 provided substantially at the center of the body case 3A. In the present embodiment, an inclination angle $\alpha$ formed by the extending direction of the guide bar 20 and the axis of the cylinder 51 is about 25 degrees. A plug 54 is provided in an end portion of the cylinder head 53 on the side of the top dead center, the plug 54 projecting rearward and upward from the body case 3A.

The exhaust port 55 of the engine 5 is connected with an exhaust pipe 55A through which the exhaust is delivered to the muffler 6 provided below the engine 5. Since the exhaust pipe 55A is curved, the exhaust discharged from the engine 5 is smoothly delivered to the muffler 6, and therefore the exhaust efficiency of the engine 5 can be improved.

As shown in FIG. 4, provided on a right end side of a crank shaft (the upper side in FIG. 4) is a centrifugal clutch 56, a sprocket 57 for rotatively driving the saw chain 21 through the centrifugal clutch 56, and an oil pump 58 arranged on the inner side of the sprocket 57.

As shown in FIG. 5, a fan 59 for cooling the engine 5 is provided on a left end side of the crank shaft (the right side in FIG. 5).

[Arrangement of Fan]

The fan 59 includes an inner blade 592 arranged on the inner side of a disc shaped flange portion 591 and an outer blade 593 arranged on the outer side of the flange portion 591. Here, the inner blade 592 arranged on the inner side of the flange portion 591 mainly takes in the air from a slit (not shown) formed on a lower portion of the body case 3A and delivers the cooling air to the engine 5 and the like, while the outer blade 593 arranged on the outer side of the flange portion 591 mainly takes in the air from a slit (not shown) formed on the case cover 3C and delivers the cooling air. Due to the provision of the inner blade 592 arranged on the inner side of the fan 59, more cooling air can be delivered, and therefore cooling efficiency of the engine 5 can be improved. The cooling air brought in by the fan 59 is also delivered to an air introducing port 633 of the muffler 6 (as shown in FIG. 6) passing below the cylinder 51.

[Arrangement of Muffler]

Figure 6:
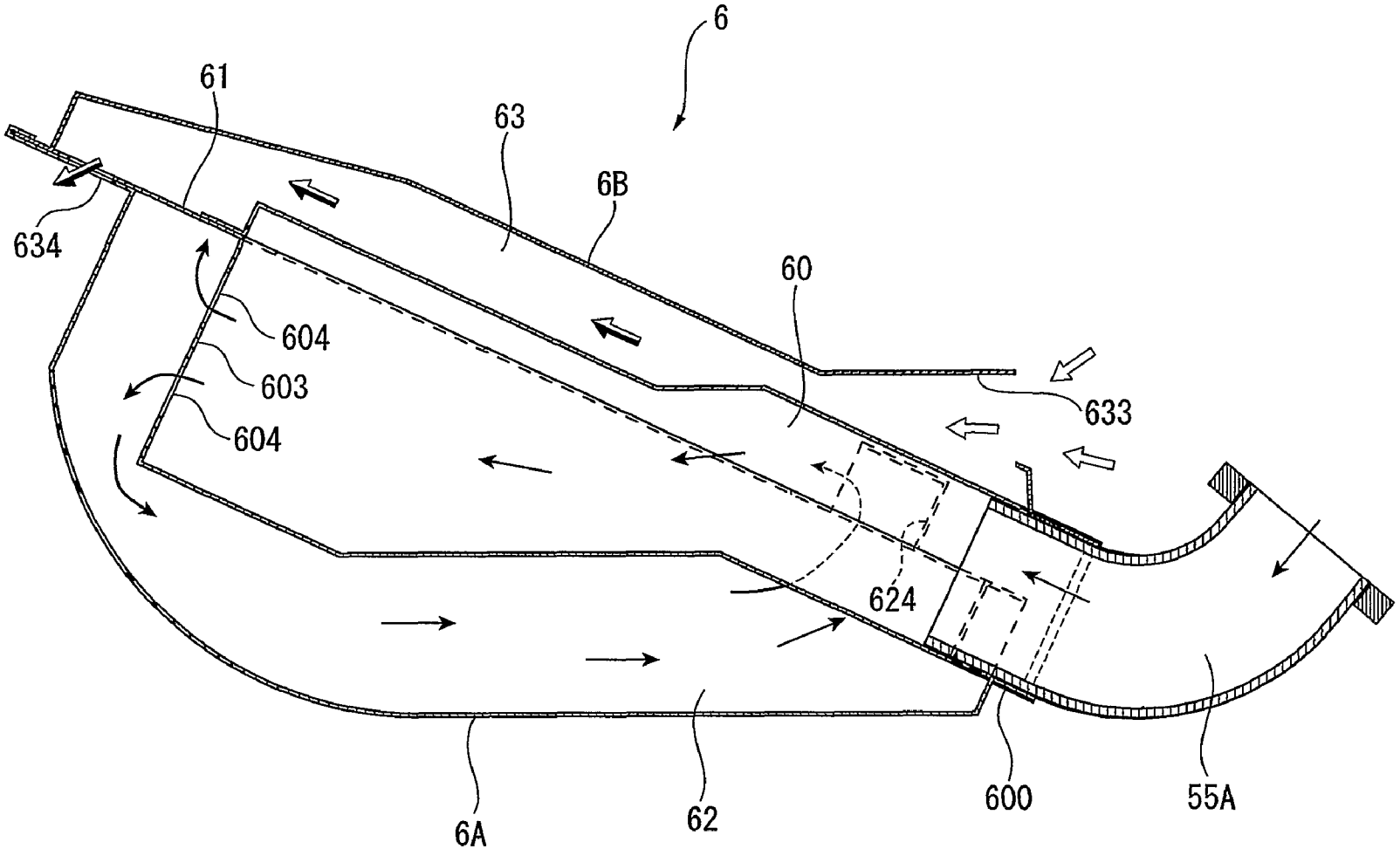
FIG. 6 is a cross section showing a muffler according to the aforesaid embodiment.
Figure 7:
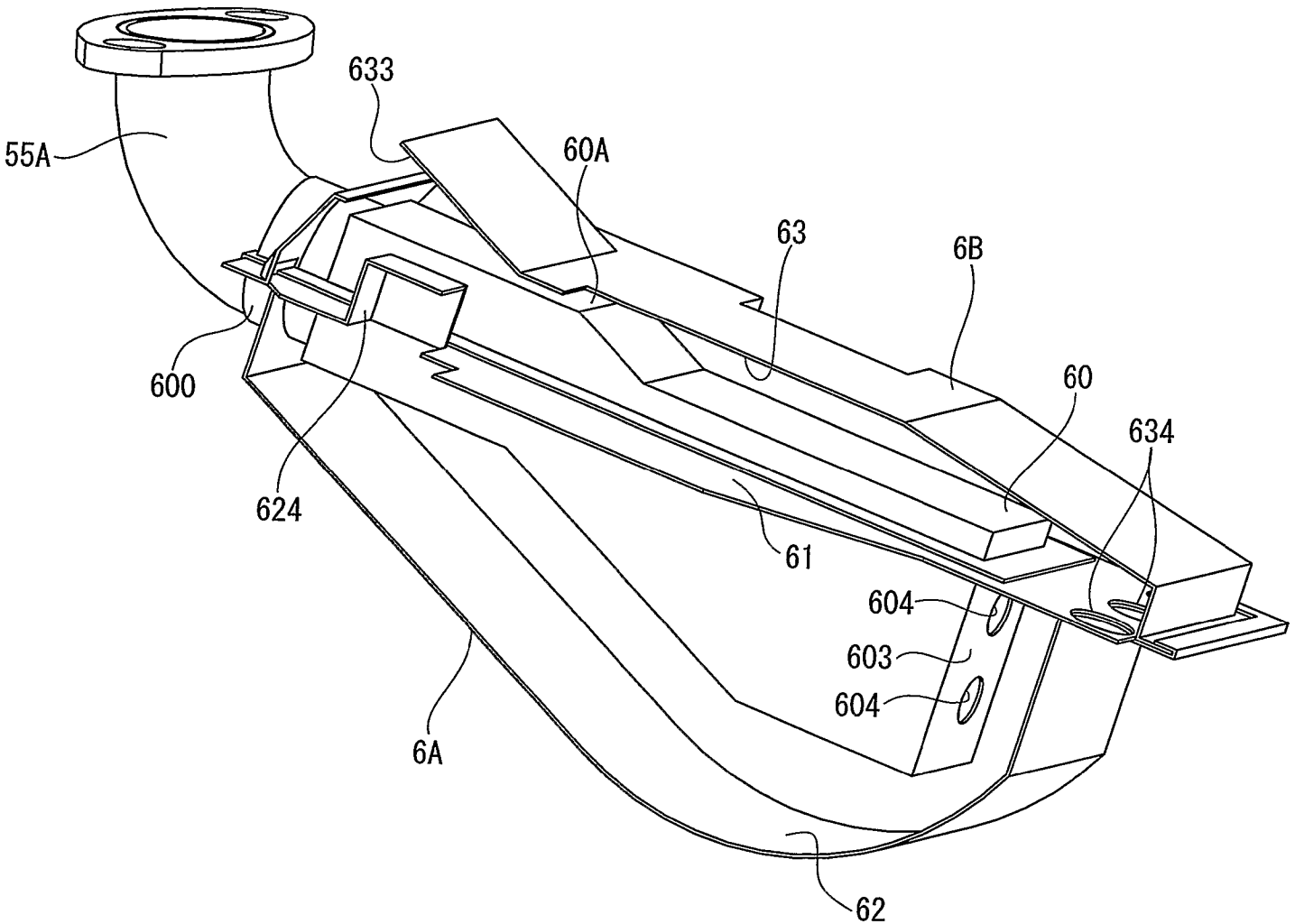
FIG. 7 is a cross-sectional perspective view showing a structure inside the muffler according to the aforesaid embodiment.

FIG. 6 is a cross section of the muffler 6, and FIG. 7 is a cross-sectional perspective view showing a structure inside the muffler 6.

As shown in FIG. 3, the muffler 6 is housed in an inner space of the body case 3A formed from a lower side to a front side of the engine 5. The muffler 6 is box shaped and includes a bottom surface 6A extending along the inner surface of the body case 3A and an upper surface 6B inclined at an angle substantially equal to the inclination angle $\alpha$ of the cylinder 51. Further, as shown in FIGS. 6 and 7, a first-muffling chamber 60 is provided inside the muffler 6, the first muffling chamber 60 communicating with the engine 5 through the exhaust pipe 55A. A partitioning plate 61 is fitted into an upper portion of the first muffling chamber 60. The partitioning plate 61 is inclined forward and upward at an angle substantially equal to the inclination angle $\alpha$ of the cylinder 51. A second muffling chamber 62 and a third muffling chamber 63 are formed outside the first muffling chamber 60, the second muffling chamber 62 being a space below the partitioning plate 61 and covering a lower side of the first muffling chamber 60, the third muffling chamber 63 being a space above the partitioning plate 61 and covering an upper side of the first muffling chamber 60.

The first muffling chamber 60 has a long front portion. The first muffling chamber 60 includes, in an upper portion and a lower portion of a front surface 603 thereof, first feed ports 604 for allowing the first muffling chamber 60 and the second muffling chamber 62 to communicate with each other. Provided on the rear right side of the partitioning plate 61 is a second feed port 624 for allowing the second muffling chamber 62 and the third muffling chamber 63 to communicate with each other. Further, an air introducing port 633 is provided on the upper surface 6B of the third muffling chamber 63, the air introducing port 633 projecting upward and opening rearward. The cooling air delivered by the fan 59 flows into the air introducing port 633. Further, a discharge port 634 is formed on a lower surface of the third muffling chamber 63 in a front end portion projecting from the second muffling chamber 62, the discharge port 634 discharging the exhaust to the exhaust outlet 640.

With such an arrangement, the exhaust delivered from the exhaust pipe 55A first passes through the first muffling chamber 60 and enters into the second muffing chamber 62 through the first feed port 604. Then, the exhaust collides with a front surface of the second muffling chamber 62 to be inverted to the rear side along the bottom surface 6A, and enters into the third muffling chamber 63 through the second feed port 624. Then, the exhaust entering into the third muffling chamber 63 is mixed with the cooling air entering from the air introducing port 633 and discharged to the exhaust outlet 640 from the discharge port 634. Then, the exhaust is discharged to the outside from the front side of the body 3 through the exhaust outlet 640.

Since the exhaust outlet 640 opens forward from the front side of the body 3, not only the exhaust can be discharged forward from the front side of the body 3, but also the exhaust sound can be propagated forward so that less exhaust sound is heard by the operator, thereby improving the work environment. Further, since the first, second and third muffling chambers 60, 62, 63 are provided inside the muffler 6, the exhaust sound can be effectively reduced. Further, since the air introducing port 633 is provided on the upper surface 6B of the third muffling chamber 63 disposed close to the engine 5, the cooling air of the engine 5 delivered by the fan 59 can smoothly flow into the third muffling chamber 63. The cooling air is mixed with the exhaust, so that the exhaust can be directly and effectively cooled. Further, since the cooling air blown into the third muffling chamber 63 cools an upper wall of the first muffling chamber 60, the exhaust from the engine 5 can be cooled to some extent in the first muffling chamber 60. Further, since the third muffling chamber 63 is arranged closer to the engine 5 than the first and second muffling chambers 60, 62 are, the radiant heat of the first and second muffling chambers 60, 62 will not be directly transmitted to the engine 5.

[Entire Arrangement of Handle]

As shown in FIGS. 1 and 2, the side handle 40 of the handle 4 has one end thereof connected with the top handle 41 and the other end thereof connected with a lower portion of the case cover 3C through a connecting spring (not shown). With such an arrangement, since the handle 4 is provided with the side handle 40 bridged between the top handle 41 and the lower portion of the case cover 3C, the operator can steadily operate the chain saw 1 by gripping the top handle 41 with one hand and gripping the side handle 40 with the other hand, thereby improving the operability. Incidentally, to obtain a stable support state, the handle 4 is connected with the body 3 through at least three connecting springs (not shown) including the connecting portion between the other end of the side handle 40 and the case cover 3C.

As shown in FIG. 2, the top handle 41 includes a grip portion 42 to be gripped by the operator, a first extending portion 43 extended by being bent from a front side of the grip portion 42 toward a lower side, a second extending portion 44 extended by being bent from a rear side of the grip portion 42 toward the lower side, and a bridge portion 401 bridged between the first extending portion 43 and the second extending portion 44.

Figure 8:
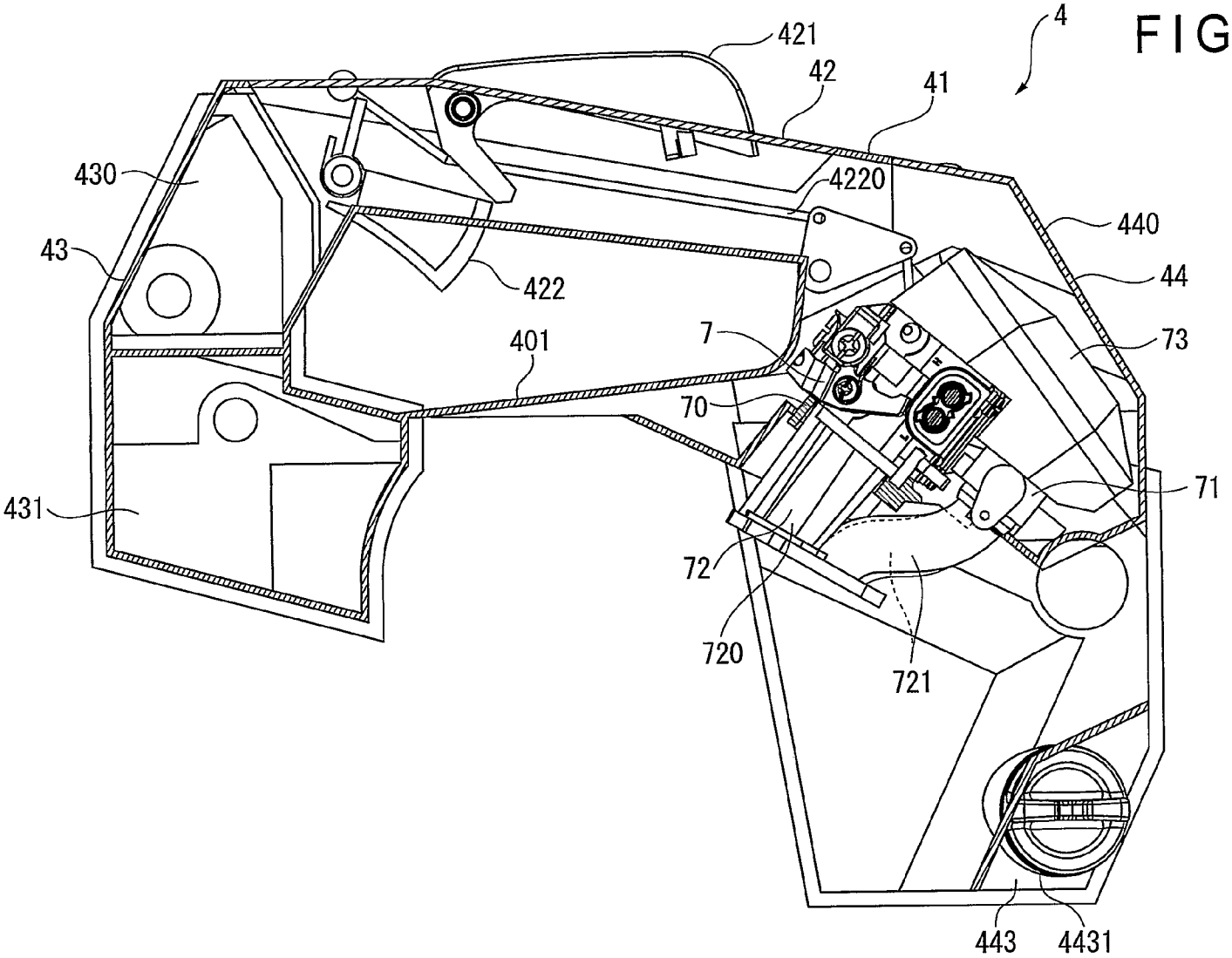
FIG. 8 is a cross section showing a top handle according to the aforesaid embodiment.

FIG. 8 is a cross section of the top handle 41.

As shown in FIGS. 2 and 8, the grip portion 42 is provided with a throttle lever 422 for adjusting the output of the engine 5 and a stopper 421 for regulating the movement of the throttle lever 422.

The first extending portion 43 includes a hollow supporter 430 and an oil tank 431 integral with a lower end of the supporter 430. The first extending portion 43 is arranged above the muffler 6. An end of the side handle 40 is attached to the supporter 430. The oil tank 431 includes a bulged portion 4310 bulging outward from the left side. A tip end portion of the bulged portion 4310 is provided with an oil supply port 4311 for storing oil for lubricating the saw chain 21. As shown in FIG. 2, the oil is fed, through oil tubes 580, 582 and powered by the oil pump 58, to the outside of a guide bar attaching portion 301A integral with the crank case 50 to be supplied to the saw chain 21. Further, an end of the bridge portion 401 is connected with a portion of the bulged portion 4310 extending toward the rear side.

The second extending portion 44 includes a handle case 440 and a fuel tank 443. The second extending portion 44 is arranged above a rear portion of the engine 5.

The handle case 440 is continued to the grip portion 42. A carburetor 7 is provided inside the handle case 440. The details of a structure around the carburetor 7 will be described later. The other end of the bridge portion 401 is connected with a lower portion of the handle case 440. The fuel tank 443 is integrally formed with the second extending portion 44 from the right side of the second extending portion 44 to the lower side. Further, a fuel supply port 4431 is provided on a lower side of the fuel tank 443. The fuel is supplied to the carburetor 7 through a fuel tube (not shown).

With such an arrangement, the body 3 and the top handle 41 of the present embodiment are connected with each other through the connecting spring, so that the vibration transmitted from the body to the top handle 41 is suppressed. Further, since the heavy oil tank 431 and fuel tank 443 are formed integrally with the top handle 41 and thereby the weight on the side of the body 3, which generates the vibration, is reduced. Consequently, the vibration transmitted to the top handle 41 is reduced, so that the vibration isolating performance of the chain saw 1 can be improved. Further, since the heavy oil tank 431 and fuel tank 443 are integrally formed respectively with the first extending portion 43 and the second extending portion 44 positioned at the front and back of the grip portion 42, good balance of weight can be achieved and operability can be improved.

Further, since the bridge portion 401 is bridged between the first extending portion 43 and the second extending portion 44, the rigidity of the top handle 41 is improved, thereby further improving the operability and the vibration isolating performance of the chain saw 1.

[Structure Around Carburetor]

Figure 9:
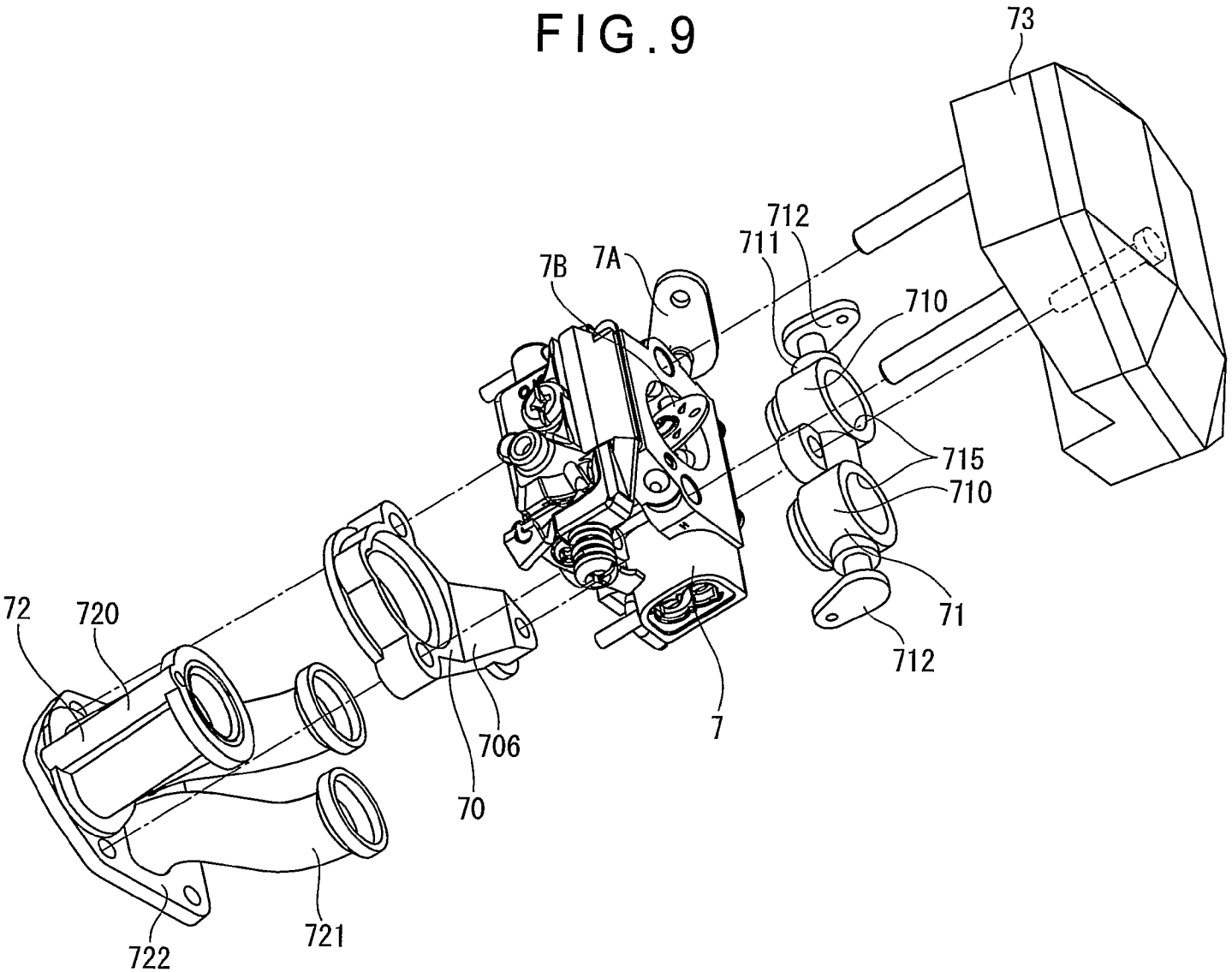
FIG. 9 is an exploded perspective view showing a structure around a carburetor according to the aforesaid embodiment.

FIG. 9 is an exploded perspective view showing a structure around the carburetor 7. Note that a connecting portion 70 is indicated in a state before being cast into the top handle 41.

As shown in FIG. 9, an air quantity adjusting device 71 disposed behind the carburetor 7 (namely, disposed below a slope on the rear side of FIG. 8) is connected with the carburetor 7 through the connecting portion 70 cast into the top handle 41. An air valve (not shown) is provided inside the air passage 715 of the air quantity adjusting device 71. The air valve is opened/closed by an air valve adjusting piece 712 provided on a lateral side of the air quantity adjusting device 71. The air valve adjusting piece 712 is connected with a throttle valve adjusting piece 7A provided in the carburetor 7 through a connecting means such as a wire. The throttle valve adjusting piece 7A provided in the carburetor 7 is connected with the throttle lever 422 through a connecting element 4220 (see FIG. 8) to open/close a throttle valve 7B.

An air cleaner 73 is provided above the carburetor 7 and the air valve, and an insulator 72 is provided below the carburetor 7 and the air valve. The insulator 72 is integrally formed by attaching an insulator air-fuel mixture passage 720 and an insulator air passage 721, both made of an elastic material having heat insulating property, to a plate 722. When assembling, the insulator 72 is connected with the insulator attaching portion 52 (see FIG. 4) of the engine 5. Note that the insulator air passage 721 should be positioned behind the insulator air-fuel mixture passage 720 (namely, positioned below the slope on the rear side of FIG. 8) when connecting the insulator 72. The insulator air-fuel mixture passage 720 allows the carburetor 7 and the air-fuel mixture port 520 to communicate with each other to feed the air-fuel mixture to the engine 5, while the insulator air passage 721 allows the air quantity adjusting device 71 and the air port 521 to communicate with each other to feed the scavenging air to the engine 5.

Due to the operation of the throttle lever 422, the throttle valve 7B is opened/closed by the throttle valve adjusting piece 7A connected with the throttle lever 422 through the connecting element 4220, so that the quantity of the air-fuel mixture to be fed to the engine 5 can be adjusted. Further, due to the operation of the throttle lever 422, the air valve is opened/closed by the air valve adjusting piece 712 connected with the throttle valve adjusting piece 7A through the connecting means such a wire, so that the quantity of the scavenging air to be fed to the engine 5 can be adjusted, and the output of the engine 5 can be adjusted. In the present embodiment, a link mechanism is formed by the air valve adjusting piece 712, the connecting means such a wire, and the throttle valve adjusting piece 7A.

The insulator air-fuel mixture passage 720 and the insulator air passage 721 are both made of an elastic material having heat insulating property, therefore not only the heat transmitted from the side of the engine 5 to the carburetor 7 can be suppressed, but also the vibration can be absorbed.

In other words, even when the vibration is generated on the side of the body 3, similar to the case where the vibration transmitted to the handle 4 is absorbed by the connecting spring made of an elastic material, since the vibration transmitted to the carburetor 7 is absorbed by the insulator air-fuel mixture passage 720 and the insulator air passage 721 both made of an elastic material, the vibration transmitted to the carburetor 7 and furthermore the vibration transmitted to the handle 4 through the carburetor 7 can be suppressed.

Further, since the insulator 72 is integrally formed by attaching the insulator air passage 721 and the insulator air-fuel mixture passage 720 to the plate 722, not only the insulator 72 can be easily handled, but also the air quantity adjusting device 71, the carburetor 7 and the engine 5 can be connected with each other with a single insulator 72, thereby simplifying assembling.

Further, since the air quantity adjusting device 71 is connected with the carburetor 7 through the connecting portion 70 cast into the top handle 41, in other words, since the air quantity adjusting device 71 is arranged close to the carburetor 7, the link mechanism that links the air valve provided in the air quantity adjusting device 71 and the throttle valve 7B provided in the carburetor 7 to each other can be made small, which further contribute to the miniaturization.

Further, in the present embodiment, by laterally disposing the engine 5, the air port 521 and the air-fuel mixture port 520 can be installed upward to the cylinder 51, and the air quantity adjusting device 71 and the carburetor 7 can be well housed in the top handle 41. Accordingly, there is no need to separately prepare a space for installing the air quantity adjusting device 71 and the carburetor 7, so that miniaturization can be achieved.

Incidentally, the present invention is not intended to be limited to the above embodiment but can include other configurations, such as the following modifications, as long as the objects of the present invention can be achieved.

For example, the muffler 6 can be mounted in an arbitrary position in a rotary direction relative to the horizontal axis. Further, the muffler 6 can be directly attached to the engine 5 not through the exhaust pipe 55A.

Although the carburetor 7 is housed in the top handle 41 in the aforesaid embodiment, the carburetor 7 also can be housed in the body case 3A, so that the corresponding space in the carburetor 7 can also be used for housing the fuel tank 443.

In the aforesaid embodiment, although the piston valve type system is adopted in which the air-fuel mixture port 520 is provided in the cylinder 51 to control the side surface of the piston to take in the air-fuel mixture, there is an alternative arrangement in which a lead valve system is adopted in which the air-fuel mixture port 520 is provided in the crank case 50 to control the lead valve to take in the air-fuel mixture. Further, the engine does not have to be a stratified scavenging 2-cycle engine.

Further, in the aforesaid embodiment, although the inclination angle $\alpha$ formed by the extending direction of the guide bar 20 and the axis of the cylinder 51 is about 25 degrees, the inclination angle $\alpha$ may be any value as long as the engine 5 is housed in the body 3 in such a manner that the cylinder 51 is extended rearward and slightly downward from a crank case 50, namely, the engine 5 is housed in the body 3 in such a manner that the cylinder is arranged in a lateral position.

Although the connecting spring as a connecting element for connecting the handle 4 and the body 3 is used in the aforesaid embodiment, any component having elasticity can be used as the connecting element as long as it can securely connect and support the handle 4 and the body 3.

The invention claimed is:

1. A chain saw comprising:

a body in which an engine for driving a saw chain is laterally housed;

a top handle which is provided above the body, and which includes a throttle lever for adjusting an output of the engine; and a muffler which is arranged below the engine at an underside of the body of the chain saw, wherein an exhaust outlet for discharging exhaust from a front side of the body to the outside is opened forward from the front side of the body.

2. The chain saw according to claim 1, wherein the muffler is provided with an air introducing port for allowing a cooling air from the engine to flow therein.

3. The chain saw according to claim 2, wherein the muffler is provided with:

a first muffling chamber that communicates with the engine through an exhaust pipe;

a second muffling chamber that communicates with the first muffling chamber and covers a lower side of the first muffling chamber; and a third muffling chamber that communicates with the second muffling chamber and covers an upper side of the first muffling chamber, and wherein the third muffling chamber is further provided with the air introducing port and a discharge port from which the exhaust is discharged to the exhaust outlet.

* * * * *